US006576389B2

(12) United States Patent
Vanbesien et al.

(10) Patent No.: US 6,576,389 B2
(45) **Date of Patent: *Jun. 10, 2003**

(54) TONER COAGULANT PROCESSES

(75) Inventors: Daryl Vanbesien, Woodbridge (CA); Raj D. Patel, Oakville (CA); Michael A. Hopper, Toronto (CA); David J. Sanders, Oakville (CA); Kurt I. Halfyard, Mississauga (CA); Danielle C. Boils, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/976,943

(22) Filed: Oct. 15, 2001

(65) Prior Publication Data

US 2003/0073024 A1 Apr. 17, 2003

(51) Int. Cl.[7] ..... G03G 9/08
(52) U.S. Cl. ..... 430/137.14
(58) Field of Search ..... 430/137.14

(56) References Cited

U.S. PATENT DOCUMENTS

| | | | | |
|---|---|---|---|---|
| 3,674,736 | A | 7/1972 | Lerman et al. | 260/41 R |
| 4,137,188 | A | 1/1979 | Uetake et al. | 252/62.1 P |
| 4,558,108 | A | 12/1985 | Alexandru et al. | 526/340 |
| 4,797,339 | A | 1/1989 | Maruyama et al. | 430/109 |
| 4,983,488 | A | 1/1991 | Tan et al. | 430/137 |
| 4,996,127 | A | 2/1991 | Hasegawa et al. | 430/109 |
| 5,066,560 | A | 11/1991 | Tan et al. | 430/137 |
| 5,278,020 | A | 1/1994 | Grushkin et al. | 430/137 |
| 5,290,654 | A | 3/1994 | Sacripante et al. | 430/137 |
| 5,308,734 | A | 5/1994 | Sacripante et al. | 430/137 |
| 5,344,738 | A | 9/1994 | Kmiecik-Lawrynowicz et al. | 430/137 |
| 5,346,797 | A | 9/1994 | Kmiecik-Lawrynowicz et al. | 430/137 |
| 5,348,832 | A | 9/1994 | Sacripante et al. | 430/109 |
| 5,364,729 | A | 11/1994 | Kmiecik-Lawrynowicz et al. | 430/137 |
| 5,370,963 | A | 12/1994 | Patel et al. | 430/137 |
| 5,804,349 | A | 9/1998 | Ong et al. | 430/110 |
| 5,827,633 | A | 10/1998 | Ong et al. | 430/137 |
| 5,840,462 | A | 11/1998 | Foucher et al. | 430/137 |
| 5,853,944 | A | 12/1998 | Foucher et al. | 430/137 |
| 5,869,215 | A | 2/1999 | Ong et al. | 430/137 |
| 5,994,020 | A | 11/1999 | Patel et al. | 430/137 |
| 6,130,021 | A | 10/2000 | Patel et al. | 430/137 |
| 6,132,924 | A | 10/2000 | Patel et al. | 430/137 |
| 6,268,102 | B1 | 7/2001 | Hopper et al. | 430/137.14 |
| 6,416,920 | B1 * | 7/2002 | Hopper et al. | 430/137.14 |

OTHER PUBLICATIONS

Copending application Ser. No. 09/877,747, filed Jun. 11, 2001, on "Toner Coagulant Processes".
Copending application Ser. No. 09/922,263, filed Aug. 16, 2001, on "Toner Coagulant Processes".
Copending application Ser. No. 08/922,437, filed Sep. 2, 1997, on "Metal–Accelerated Toner Processes", and published in Japan as Publication No. 11153883 on Jun. 8, 1999.

* cited by examiner

*Primary Examiner*—Mark A. Chapman
(74) *Attorney, Agent, or Firm*—Eugene O. Palazoo

(57) ABSTRACT

A process for the preparation of toner by, for example, mixing a colorant, a latex, a wax and a dual coagulant mixture comprising water solubilized silica with an alumina coating referred to as aluminized silica and a polyaluminum chloride to provide, for example, a toner composition of different gloss levels when fused.

31 Claims, No Drawings

TONER COAGULANT PROCESSES

COPENDING APPLICATIONS AND RELATED PATENTS

Illustrated in U.S. Pat. No. 6,500,597, filed Aug. 3, 2001 on "Toner Coagulant Processes", the disclosure of which is totally incorporated herein by reference, is a process comprising (i) blending a colorant dispersion of a colorant, water, and an anionic surfactant, or a nonionic surfactant with (ii) a latex emulsion comprised of resin, water, and an ionic surfactant;

(iii) adding to the resulting blend a first coagulant of polyaluminum sulfosilicate (PASS) and a second cationic co-coagulant having an opposite charge polarity to that of the latex surfactant;

(iv) heating the resulting mixture below about the glass transition temperature (Tg) of the latex resin;

(v) adjusting with a base the pH of the resulting toner aggregate mixture from a pH which is in the range of about 1.8 to about 3 to a pH range of about 5 to about 9;

(vi) heating above about the Tg of the latex resin;

(vii) changing the pH of the mixture by the addition of a metal salt to arrive at a pH of from about 2.8 to about 5; and (viii) optionally isolating the product.

Illustrated in U.S. Pat. No. 6,495,302, filed Jun. 7, 2001 on "Toner Coagulant Processes", the disclosure of which is totally incorporated herein by reference, is a process for the preparation of toner comprising (i) generating a latex emulsion of resin, water, and an ionic surfactant, and a colorant dispersion of a colorant, water, an ionic surfactant, or a nonionic surfactant, and wherein (ii) the latex emulsion is blended with the colorant dispersion;

(iii) adding to the resulting blend containing the latex and colorant a coagulant of a polyaluminum chloride with an opposite charge to that of the ionic surfactant latex colorant;

(iv) heating the resulting mixture below or equal to about the glass transition temperature (Tg) of the latex resin to form aggregates;

(v) optionally adding a second latex comprised of submicron resin particles suspended in an aqueous phase (iv) resulting in a shell or coating wherein the shell is optionally of from about 0.1 to about 1 micron in thickness, and wherein optionally the shell coating is contained on 100 percent of the aggregates;

(vi) adding an organic water soluble or water insoluble chelating component to the aggregates of (v) particles, followed by adding a base to change the resulting toner aggregate mixture from a pH which is initially from about 1.9 to about 3 to a pH of about 5 to about 9;

(vii) heating the resulting aggregate suspension of (vi) above about the Tg of the latex resin;

(viii) optionally retaining the mixture (vii) at a temperature of from about 70° C. to about 95° C.;

(ix) changing the pH of the (viii) mixture by the addition of an acid to arrive at a pH of about 1.7 to about 4; and (x) optionally isolating the toner.

In U.S. Pat. No. 6,132,924, the disclosure of which is totally incorporated herein by reference, there is illustrated a process for the preparation of toner comprising mixing a colorant, a latex, and two coagulants, followed by aggregation and coalescence and wherein one of the coagulants may be polyaluminum chloride.

In U.S. Pat. No. 6,268,102, the disclosure of which is totally incorporated herein by reference, there is illustrated a process for the preparation of toner comprising mixing a colorant, a latex, and two coagulants, followed by aggregation and coalescence, and wherein one of the coagulants is a polyaluminum sulfosilicate.

Also illustrated in U.S. Pat. No. 5,994,020 and U.S. Pat. No. 6,130,021, the disclosures of which are totally incorporated herein by reference, are toner preparation processes, and more specifically, a process for the preparation of toner comprising (i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant in the presence of a coagulant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin to initiate aggregation; optionally adding an ionic surfactant stabilizer; heating at a temperature about equal to, or about above about the Tg of the latex resin; and optionally cooling, isolating, washing, and drying the toner.

The appropriate components and processes of the above recited copending applications and patents may be selected for the processes of the present invention in embodiments thereof.

BACKGROUND

The present invention is generally directed to toner processes, and more specifically, to chemical processes which involve the aggregation and fusion of latex resin, colorant like pigment, or dye, and additive particles into toner particles, and wherein aggregation can be primarily controlled by utilizing a two cationic coagulants comprised of (i) a polyaluminum halide, and (ii) a silica, such as a colloidal silica with an alumina coating, that is for example, a colloidal dispersion of discrete spherical silica particles of pure, about 100 percent, amorphous silicon dioxide and wherein the surface is modified to attain cationic properties with a coating of $Al_2O_3$ on the silica core thereby providing a functionalized colloidal silica, and wherein there is selected a latex comprised, for example, of submicron resin particles in the size range of, for example, about 0.1 to about 0.3 micron in volume average diameter, suspended in an aqueous phase comprised of a mixture of water, an anionic surfactant and a colorant dispersion comprising submicron pigment particles in the size range of, for example, about 0.08 to about 0.3 micron in volume average diameter as measured by a disc centrifuge suspended in an aqueous phase of water and an anionic surfactant, and optionally a nonionic surfactant or mixtures thereof, which are blended together in the presence of a dual coagulant, and wherein the resultant blend is stirred and heated to a temperature below the resin Tg, resulting in aggregates to which optionally is added a second latex to provide a coating on the formed toner aggregates, followed by adjusting the pH of the mixture with a base, and heating the mixture to a temperature above the resin Tg, followed by adjusting the pH of the mixture with an acid to fuse the aggregates. More specifically, the present invention is generally directed to the aggregation and coalescence or fusion of latex, colorant like pigment, dye, and additives like a wax in the presence of a dual coagulant systems, such as polyaluminum chloride (PAC) and aluminum coated silica, wherein when the PAC concentration is about 0.14 to 0.02 percent by weight of toner and the aluminum coated silica concentration about 0.5 to 2 percent by weight of toner provides a toner which exhibits a high gloss and a lower minimum fixing temperature (MFT) wherein the MFT is reduced by a minimum of 10° C., and when the define PAC concentration is about 0.3 to 0.15 percent by weight of toner and the aluminum coated silica concentration is in the range of 1 and 3 percent by weight of toner, and wherein the toner prepared exhibits low gloss or matte wherein low gloss is, for example, from about 8 GGU to about 35 GGU and an increase of about 10° C. to about 30° C. in the hot offset temperature is obtained, compared to a toner prepared just by PAC alone and wherein the dual coagulants are particulates, for example, in the diameter size range of about 0.005 about 0.2 micron, and wherein there are generated toner compositions with, for example, a volume average diameter of from about 1 micron to about 25 microns, and more specifically, from about 2 microns to about 10 microns, and with a narrow particle size distribution of, for example, from about 1.10 to about 1.33, and more specifically, a size distribution in the range of about 1.11 to about 1.26, the size and size distribution being measured by a Coulter Counter without the need to resort to conventional pulverization and classification methods. The resulting toners after washing exhibits provides a suitable toner triboelectrical charge in the range of about −35 to about −15 $\mu$C/g at 20 percent RH. The toners generated can be selected for known electrophotographic imaging and printing processes, including digital color processes such as in the Xerox Corporation 5090 or the Xerox Corporation Docutech 265.

Toners prepared by the process of the present invention possess a number of advantages as compared to a number of toners generated by known emulsion aggregation processes, which advantages include, for example, the ability to control the finish of the fused developed toner image, for example a glossy or a matte image by controlling the amount of the colloidal aluminized silica and the amount of PAC used as the coagulants, wherein when the PAC concentration is between 0.14 to 0.02 percent by weight of toner and the aluminum coated silica, or referred as aluminized silica concentration is between 0.5 to 2.0 percent by weight of toner provides a toner which exhibits a high gloss and a lower minimum fixing temperature (MFT) wherein the MFT is reduced by a minimum of 10° C., and when the PAC concentration is between 0.3 to 0.15 percent by weight of toner and the aluminum coated silica concentration is in the range of 1 and 3 percent by weight of toner, the toner prepared exhibits low gloss or matte wherein low gloss is defined as 35 GGU or less and an increase in hot offset.

Another advantage of the present invention in embodiments resides in using a colloidal aluminized silica as an additional coagulant which permits about 100 percent, incorporation of the silica into the toner particles as compared to using colloidal silica in the toner formulation, which is then aggregated with other known coagulants, such as polyaluminum chloride (PAC) or polyaluminum sulfosilicate (PASS) wherein the silica retention is, for example, less than about 20 percent. Furthermore, another advantage of the present invention in embodiments resides in an increase of reactor productivity by about 10 to 30 percent as compared to a number of known emulsion aggregation processes where the coagulants utilized are PAC and PASS. Furthermore, when the toners generated are roll milled and aged over a period of, for example, about 2 to about 3 hours there results stable and negative toner charging with, for example, no or minimal wrong sign positively charged toner.

The toners generated with the processes of the present invention are especially useful for imaging processes, especially xerographic processes, which usually require toner transfer efficiency in excess of greater than about 90 percent, such as those with a compact machine design without a cleaner or those that are designed to provide high quality colored images with excellent image resolution, acceptable signal-to-noise ratio, and image uniformity.

REFERENCES

In xerographic systems, especially color systems, small sized toners of preferably from about 2 to about 8 microns volume average diameter are of value to the achievement of high image quality for process color applications. Also, of value is to achieve a low image pile height to eliminate, or minimize image feel and avoid paper curling after fusing. Paper curling can be present in xerographic color processes primarily because of the presence of relatively high toner coverage as a result of the application of three to four color toners. During fusing, moisture escapes from the paper due to high fusing temperatures of from about 120° C. to about 200° C. In the situation wherein only one layer of toner is selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

Also, it is desired in some instances to select certain toner particle sizes, such as from about 2 to about 15 microns, and with a high colorant, especially pigment loading such as from about 4 to about 15 percent by weight of toner, so that the mass of toner for attaining a certain optical density and color gamut can be reduced to eliminate or minimize paper curl. Lower toner mass also ensures the achievement of image uniformity. However, higher pigment loadings often adversely affect the charging behavior of toners. For example, the toner charge levels may be too low for proper toner development or the charge distributions may be too wide and toners of wrong charge polarity may be present.

Furthermore, higher pigment loadings may also result in the sensitivity of charging behavior to charges in environmental conditions such as temperature and humidity. Toners prepared in accordance with the processes of the present invention minimize, or avoid these disadvantages.

There is illustrated in U.S. Pat. No. 4,996,127, the disclosure of which is totally incorporated herein by reference, a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, the disclosure of which is totally incorporated herein by reference, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 microns, are obtained. This process results, it is believed, in the formation of particles with a wide particle size distribution. Similarly, the aforementioned disadvantages, for example poor particle size distributions, are obtained hence classification is required resulting in low toner yields, are illustrated in other prior art, such as U.S. Pat. No. 4,797,339, the disclosure of which is totally incorporated herein by reference, wherein there is disclosed a process for the preparation of toners by resin emulsion polymerization, wherein similar to the '127 patent certain polar resins are selected; and U.S. Pat. No. 4,558,108, the disclosure of which is totally incorporated herein by reference, wherein there is disclosed a process for the preparation of a copolymer of styrene and butadiene by specific suspension polymerization. Other prior art includes U.S. Pat. Nos. 3,674,736; 4,137,188 and 5,066,560, the disclosures of which are totally incorporated herein by reference.

Emulsion/aggregation/coalescence processes for the preparation of toners are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256, 5,501,935, 5,723,253, 5,744,520, 5,763,133, 5,766,818, 5,747,215, 5,827,633, 5,853,944, 5,804,349, 5,840,462, and 5,869,215. The appropriate components and processes of the above Xerox Corporation patents can be selected for the processes of the present invention in embodiments thereof.

SUMMARY

It is a feature of the present invention to provide toner processes with many of the advantages illustrated herein.

In another feature of the present invention there are provided simple and economical processes for the preparation of black and colored toner compositions with excellent colorant dispersion thus enabling the achievement of high color print quality.

In another feature of the present invention resides the preparation of black or colored toners, which when fused results in a glossy or a matte finish depending on the coagulant concentration, for example a toner formulation containing higher concentrations of colloidal aluminized silica and a higher concentration of polymetal halide, such as PAC or PASS, will result in a matte type of a finish when the concentration of the aluminized silica is from about 0.5 to about 2 percent by weight of toner and the PAC concentration is in the range of about 0.14 to about 0.02 percent by weight of toner, results in a matte finish and wherein matte finish, for example, is from about 10 to about 35, or wherein a toner formulation with less colloidal aluminized silica, for example from about 1 to about 3 percent by weight of toner and the PAC concentration is from about 0.3 to about 0.15 percent by weight of toner can result in a glossy finish which is generally, for example, from about 35 to about 80 GGU.

In another feature of the present invention there is provided a process of preparing toners wherein the yield is increased by 50 to 60 percent as compared to a number of known emulsion aggregation processes.

Further, in another feature of the present invention there are provided processes capable of generating acceptable stable toner triboelectrical toner values with minimum toner washings.

In yet another feature of the present invention there is provided a process in which both the coagulants are introduced in the blending of latex and colorant, and optionally the polymetal halide is added prior to or during aggregation wherein the resulting toners give similar toner performance.

Additionally, in a further feature of the present invention there is provided a process for the preparation of toner with a volume average diameter of from about 1 to about 25 microns, and preferably from about 2 to about 12 microns, and a particle size distribution of from about 1.10 to about 1.28, and preferably from about 1.15 to about 1.25, each as measured by a Coulter Counter without the need to resort to conventional classifications to narrow the toner particle size distribution.

Moreover, in a further feature of the present invention there are provided processes for the preparation of toner by aggregation and coalescence, or fusion (aggregation/coalescence) of latex resin, colorant, and additive particles, and wherein there can be selected a latex prepared by batch emulsion polymerization process or prepared by semicontinuous polymerizations.

In yet another feature of the present invention there are provided toner compositions with low fusing temperatures of, for example, from about 120° C. to about 185° C., and which toner compositions exhibit excellent blocking characteristics, for example, at and above about, or equal to about 45° C.

In still a further feature of the present invention there are provided toner compositions which provide high image projection efficiency, such as for example over 75 percent as measured by the Match Scan II spectrophotometer available from Million-Roy.

Aspects of the present invention relate to a process comprising mixing a colorant dispersion, a latex emulsion, a wax dispersion and coagulants comprising at least a colloidal alumina coated silica, and a polymetal halide; wherein the colorant is a colorant dispersion comprised of (i) a colorant, water, and an ionic surfactant, or a nonionic surfactant, and wherein the latex is an emulsion comprised of an ionic surfactant, water and resin;

(ii) wherein the colorant dispersion is blended with the latex emulsion, and thereafter adding a wax dispersion comprised of submicron wax particles of a size of from about 0.1 to about 0.5 micron in diameter by volume, which wax is dispersed in an ionic surfactant of the same charge polarity of the ionic latex surfactant;

(iii) adding to the resulting blend a dual coagulant comprised of alumina coated silica and polyaluminum chloride to thereby initiate flocculation or aggregation of the resin latex, the colorant, and the wax when present;

(iv) heating the resulting mixture below about, or about equal to the glass transition temperature (Tg) of the latex resin to form toner sized aggregates;

(v) adding to the formed toner aggregates a second latex comprised of resin suspended in an aqueous phase containing an ionic surfactant and water;

(vi) adding to the resulting mixture a base to thereby change the pH, which is in the range of about 2 to about 2.9, to arrive at a pH of from about 5 to about 8 for the resulting toner aggregate mixture;

(vii) heating the resulting aggregate suspension of (vi) above about, or about equal to the Tg of the latex resin of (i);

(viii) retaining the mixture temperature in the range of from about 70° C. to about 95° C. optionally for a period of about 10 to about 60 minutes, followed by a pH reduction with an acid to arrive at a pH in the range of about 3.5 to about 5 to assist in permitting the fusion or coalescence of the toner aggregates;

(ix) optionally washing the resulting toner slurry; and (x) isolating the toner; and wherein colloidal silica is a colloidal dispersion of discrete spherical particles with a purity of from about 80 to 100 percent pure amorphous silicon dioxide, and wherein the surface thereof has an alumina coating of $Al_2O_3$; the polymetal salt selected can be either a polyaluminum chloride or polyaluminum sulfosilicate with the amounts of colloidal alumina coated silica being used is from about 0.05 to about 2 percent by weight of toner and the polyaluminum chloride amount is about 0.14 to about 0.02 percent by weight of toner providing a toner exhibiting a glossy finish; also wherein the amounts of colloidal alumina coated silica selected is about 1 to about 3 percent by weight of toner and the polyaluminum chloride amount is about 0.3 to about 0.15 percent by weight of toner, and wherein there is provided a toner exhibiting a matte finish with a gloss of 8 to about 35 GGU measured at a temperature of 180° C.; a process for generating a glossy toner exhibiting a viscosity which is about 35 to about 250 pascals per second at about 125° C. to about 150° C.; a process for generating a matte toner exhibiting a viscosity of about 260 to about 500 pascals per second at from about 150° C. to about 190° C.; a process for generating a glossy toner with a value of about 35 to about 80 GGU; the minimum fix temperature of the toner is from about 140° C. to about 155° C.; a process wherein the alumina ($Al_2O_3$) coating has a thickness of about 0.001 to about 0.01 micron, and wherein (viii), (ix) and (x) are accomplished; the latex resin particle is about 0.15 to about 0.3 micron in volume average diameter; colorant is a pigment, a dye or mixtures thereof, and which colorant optionally is submicron in size of about 0.08 to about 0.34 micron in average volume diameter; the colloidal for the alumina coated silica is about 0.005 to about 0.1 micron in diameter; the base is selected from the group consisting of sodium hydroxide, potassium hydroxide, and ammonium hydroxide; there is added to the formed toner aggregates a second latex comprised of submicron resin particles suspended in an aqueous phase containing an anionic surfactant, and wherein the second latex is selected in an amount of from about 10 to about 40 percent by weight of the initial latex to form a shell thereover, and which shell is of a thickness of about 0.2 to about 0.8 micron on the formed aggregates; the added latex contains the same resin as the initial latex of (i), or wherein the added latex contains a dissimilar resin than that of the initial latex; the pH of the mixture resulting in (vi) is increased from about 2 to about 2.6 to about 5 to about 8, and wherein the base functions primarily as a stabilizer for the aggregates during coalescence (vii), and no or minimal toner particle size or GSD increases result; the temperature at which toner sized aggregates are formed controls the size of the aggregates, and wherein the final toner size is from about 2 to about 15 microns in volume average diameter; the aggregation (iv) temperature is from about 45° C. to about 60° C., and wherein the coalescence or fusion temperature of (vii) is from about 85° C. to about 95° C.; the colorant is a pigment, and wherein the pigment is in the form of dispersion, and which dispersion contains an ionic surfactant and optionally a nonionic surfactant, and wherein the alumina coated silica and the polymetal halide, which is polyaluminum chloride, are of a colloidal size and function as a coagulant and assist in the enablement of aggregation of the latex and the colorant; a process wherein the latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); the latex contains a resin selected from the group consisting of poly (styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly (propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly (styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); the colorant is carbon black, cyan, yellow, magenta, orange, green, violet or mixtures thereof; the toner isolated is from about 2 to about 15 microns in volume average diameter, and the particle size distribution thereof is from about 1.15 to about 1.30; and wherein there is added to the surface of the formed toner metal salts, metal salts of fatty acids, silicas, metal oxides, or mixtures thereof, each in an amount of from about 0.1 to about 10 weight percent of the obtained toner; a process wherein the colloidal alumina coated silica is water solubilized in a slightly acidic pH environment, and wherein the pH is about 3 to about 6.5; a toner process comprising the mixing of a colorant dispersion, a latex emulsion, a wax dispersion, a colloidal alumina coated silica, and a polymetal halide, and wherein the mixture is aggregated by heating below the latex resin glass transition temperature, and thereafter fusing the resulting aggregates by heating above the latex resin glass transition temperature, wherein the aggregate mixture is at a pH of from about 5 to about 8, and wherein the latex is comprised of resin, nonionic surfactant, ionic surfactant, and water; a process for the preparation of toner comprising mixing a colorant, a latex, a colloidal alumina coated silica, and a polymetal halide, wherein said colloidal is of a size diameter of from about 20 to about 150 nanometers, and optionally wherein the polymetal salt is a polyaluminum chloride or a polyaluminum sulfosilicate, and which coagulants primarily assist in permitting aggregation and coalescence of the colorant, the latex resin and the wax, and wherein the halide is a polyaluminum chloride; a process wherein the polymetal salt selected can be either a polyaluminum chloride, a polyaluminum bromide, or a polyaluminum sulfosilicate; a process for preparing toner compositions with a dual coagulant, such as alumina coated silica and polyaluminum chloride (PAC), wherein the alumina coated silica concentration is between about 0.5 to about 2 percent by weight of toner and the PAC concentration is between about 0.14 to about 0.02 percent by weight of toner to provide a toner which exhibits a high gloss where the gloss is greater than 30 GGU and the storage modulus (G') measured at a temperature of 180° C. is about 200 to about 1,500 and a lower minimum fixing temperature (MFT) is observed, wherein the MFT is reduced by a minimum of 10° C.; a process for the preparation of a toner that enables a matte developed finish when, for example, the alumina coated silica amount is about 1 and about 3 percent by weight of toner and the PAC concentration is about 0.3 to about 0.15 percent by weight of toner, and wherein the toner can exhibit a low matte finish where the gloss of the toner is less than about 30 GGU and the storage modulus (G'), measured at 180° C. is about 1,500 to about 3,500 and an increase in hot offset temperature of about 10° C. to 30° C. compared to a toner prepared with PAC alone. The viscosity ($\eta^*$) measure for a glossy toner at a temperature of 180° C. is about 35 to about 250 Pa/s, wherein a matte toner exhibits a viscosity measured at a temperature of 180° C. in about 260 to about 600 Pa/s.

The complex modulus refers, for example, to $$G^*=G'+iG'',$$

where i is an imaginary unit;

G' is the storage (or elastic) modulus; and

G" is the loss (viscous) modulus.

The rheology of a polymer can be assessed, for example, by the response to the material to an applied force. For measurement convenience, the force is generally applied in a periodic fashion (i.e. at constant frequency). As the materials are also generally non-linear in behavior, the response of the material will be frequency dependent. The response of a softened polymer shows a component in phase with the applied force and a component out of phase with the periodically applied force. Such conditions are conveniently described by using the notation of complex numbers (x+iy) where x would be the signal in phase with the applied force and y the component out of phase with the applied force. The sum, x+iy, represents the complete response of the material to the periodically applied force. In rheology, the complex modulus $$G^*=G'=iG''$$

is the sum of the in phase elastic or storage modulus G' and the out of phase viscous or loss modulus G". Similarly, the complex viscosity is the sum of two out of phase responses.

The ratio of the elastic stress to strain is the storage (or elastic) modulus G' and the ratio of the viscous stress to strain is the loss (viscous) modulus G". The complex modulus, G*, is a measure of a material's overall resistance to deformation.

The dynamic viscosity is a measure of the shear rate dependence of the stress and is calculated by dividing the elastic and viscous stress by the stain rate to give $\eta'$ and $\eta''$. The complex viscosity, $\eta^*$, ($\eta^*$ is the vector sum of the elastic and viscous dynamic viscosities)

$$\eta^*=\eta'+i\eta''$$

and wherein there resides a toner process capable of providing a matte fused image, whose minimum fix temperature (MFT) is at least 10° C. lower and the hot offset temperature is at least 10° C. higher than that of a comparative toner made using a single coagulant; a process for the preparation of toner comprising mixing a colorant, a latex, a wax and dual coagulant comprised of PAC and a colloidal silica with an alumina coating, that is, for example, a colloidal coated aluminized silica as a coagulant; a process for the preparation of toner comprising mixing a colorant, a latex, and a coated aluminized silica as a coagulant, which permits the incorporation of the silica into the aggregates comprised of the latex, colorant followed by the addition of the second coagulant, such as PAC, permitting aggregation and coalescence of colorant, latex resin, and when present wax; a process wherein the colorant is a colorant dispersion comprised of (i) a colorant, water, an ionic surfactant, or a nonionic surfactant, and wherein the latex selected is an emulsion comprised of an anionic surfactant, water and resin;

(ii) wherein the colorant dispersion is blended with the latex emulsion, and thereafter, optionally adding a wax dispersion comprised of submicron wax particles in the size of from about 0.1 to about 0.5 micron in diameter by volume, which wax is dispersed in an ionic surfactant of the same charge polarity of the latex ionic surfactant present;

(iii) adding to the resulting blend a dual coagulant comprised of alumina coated silica and a polyaluminum chloride wherein the positively charged aluminum ions initiate flocculation or aggregation of the resin latex and the colorant;

(iv) heating the resulting mixture below about the glass transition temperature (Tg) of the latex resin to form toner sized aggregates;

(v) optionally adding a latex comprised of resin particles suspended in an aqueous phase containing an anionic surfactant;

(vi) adding to the resulting mixture a base to thereby arrive at a pH of from about 5 to about 8 for the resulting toner aggregate mixture;

(vii) heating the resulting aggregate suspension of (vi) above about to the Tg of the latex resin;

(viii) optionally retaining the mixture (vii) at temperature in the range of from about 70° C. to about 95° C. for a period of, for example, about 10 to about 60 minutes, followed by a pH reduction with an acid to arrive at a pH in the range of about 3.5 to about 5 to assist in permitting the fusion or coalescence of the toner aggregates;

(ix) separating and washing the resulting toner slurry; and isolating the toner by, for example, filtration, centrifuge, press filters, and the like; a process wherein the base is selected from the group consisting of sodium hydroxide, potassium hydroxide, and ammonium hydroxide; a process wherein the acid is selected from the group consisting of nitric acid, sulfuric acid, hydrochloric acid, citric acid or acetic acid; a process wherein there is added to the formed toner aggregates a second latex comprised of submicron resin particles suspended in an aqueous phase containing an ionic surfactant, and wherein the second latex is selected in an amount of about 10 to about 40 percent by weight of the initial latex (i) to form a shell or coating on the first latex; a process wherein the added latex contains the same resin as the initial latex, or wherein the added latex contains a dissimilar resin than that of the initial latex (i); a process wherein the aggregation (iv) is accomplished by heating at a temperature below about the glass transition temperature of the polymer contained in the latex; a process wherein the coalescence (vii) is accomplished by heating at a temperature of above about the glass transition temperature of the polymer contained in the latex; a process wherein the aggregation temperature is from about 40° C. to about 60° C.; a process wherein the coalescence temperature is from about 75° C. to about 97° C.; a process wherein the temperature at which the aggregation is accomplished controls the size of the aggregates, and wherein the final toner size is from about 2 to about 15 microns in volume average diameter; a process wherein the aggregation (iv) temperature is from about 45° C. to about 58° C., and wherein the coalescence or fusion temperature of (vii) and (viii) is from about 85° C. to about 95° C.; a process wherein the colorant is a pigment, and wherein the pigment is in the form of dispersion, and which dispersion contains an ionic surfactant, and wherein the colloidal aluminized silica and the polyaluminum chloride (PAC) function as a coagulants and enables aggregation of the latex and the colorant; a process wherein the colorant is carbon black, cyan, yellow, magenta, or mixtures thereof; a process wherein the toner isolated is from about 2 to about 25 microns in volume average diameter, and the particle size distribution (GSD) thereof is from about 1.15 to about 1.30; and wherein there is added to the surface of the formed toner additives, such as metal salts, metal salts of fatty acids, silicas, or metal oxides, each in an amount of from about 0.1 to about 10 weight percent of the obtained toner; a process which comprises mixing a latex, surfactant and colorant; heating in the presence of a colloidal aluminized silica (aluminized silica) and PAC the resulting mixture below about, or equal to about the glass transition temperature of the latex resin; followed by the addition of a base to stabilize the toner aggregates; thereafter heating the resulting aggregates above about, or about equal to the glass transition temperature of the resin followed by a reduction in pH with an acid, followed by additional heating; and isolating, washing and drying the toner; a process wherein prior to isolating the toner heating is retained at a temperature of from about 70° C. to about 95° C. for a period of about 1 to about 6 hours and preferably about 1.5 to about 4 hours at a pH in the range of about 3.5 to about 5 until fusion or coalescence of the aggregates is accomplished; a process wherein a dual coagulant systems, such as polyaluminum chloride (PAC), and aluminum coated silica, wherein when the PAC concentration is about 0.14 to about 0.02 percent by weight of toner and the aluminum coated silica concentration is about 0.5 to about 2 percent by weight of toner provides a toner which exhibits a high gloss and a lower minimum fixing temperature (MFT) wherein the MFT is reduced by a minimum of 10° C., and when the PAC concentration is about 0.3 to about 0.15 percent by weight of toner and the aluminum coated silica concentration is in the range of 1 and 3 percent by weight of toner, the toner prepared exhibits low gloss or matte wherein low gloss is defined as 35 GGU or less and an increase in hot offset; a process wherein the colloidal aluminized silica has a coating of, for example, about 0.001 to about 0.01 micron thickness of alumina ($Al_2O_3$); a process for the preparation of toner comprising the mixing of a colorant dispersion, a latex emulsion, a wax dispersion polyaluminum chloride and a coated colloidal aluminized silica, and wherein the mixture is aggregated by heating below the latex resin glass transition temperature, and fusing the resulting aggregate by heating above the latex resin glass transition temperature, wherein the aggregate mixture is initially at a pH of from about 5 to about 8 followed by a reduction of the pH to about 3 to about 5, and wherein the latex is comprised of resin, an ionic surfactant, and water; a process wherein the colloidal aluminized silica and PAC function as a coagulant and enables or assists in enablement of the aggregation; a process wherein the colorant is a colorant dispersion comprised of (i) submicron pigment particles in the size diameter range of 0.08 to 0.3 micron dispersed in water, and an ionic surfactant; the latex is a latex emulsion comprised of submicron resin particles in the size range of 0.12 to 0.5 micron suspended in water, and ionic surfactant; and wherein the (ii) colorant dispersion is blended with the latex emulsion followed by adding a wax dispersion comprised of submicron particles in the optional diameter size range of about 0.1 to about 0.4 micron dispersed in an anionic surfactant of the same charge polarity as that of the ionic surfactant in the latex emulsion;

(iii) adding to the resulting blend containing the latex and colorant dual coagulant comprising of colloidal aluminized silica and PAC to initiate flocculation or aggregation of the resin latex, colorant and wax particles;

(iv) heating the resulting mixture below or about equal to the glass transition temperature (Tg) of the latex resin to form toner sized aggregates;

(v) adding a second latex comprised of submicron resin particles suspended in an aqueous phase containing an ionic surfactant to the formed toner aggregates resulting in a shell formation, the shell is, for example, of from about 0.1 to about 5 microns in thickness;

(vi) adjusting with a base the pH of the resulting toner aggregate mixture to about 5 to about 9 to primarily stabilize the aggregate particles;

(vii) heating and fusing the resulting aggregate suspension of (vi) above the Tg of the latex resin;

(viii) retaining the mixture (vii) temperature in the range of from about 70° C. to about 95° C. to initiate the fusion or coalescence of the toner aggregates, (ix) changing the pH of the above (viii) mixture with an acid to arrive at a pH in the range of about 2.8 to about 6, and more specifically, in the range of about 3.5 to about 5 to accelerate the fusion or the coalescence resulting in toner particle comprised of resin, colorant, and wax, wherein the particle size is about 2 about 25 microns;

(x) washing with water the resulting toner slurry; and (xi) isolating the toner; followed by drying the toner; a process wherein there is added to the formed toner aggregates a second latex in the amount of about 10 to about 40 percent by weight of the initial latex, and more specifically, in an amount of about 15 to about 30 weight percent to form a shell or coating on the aggregates where the thickness of the shell or coating is in the range of 0.2 to 0.8 micron; a process wherein the added latex comprises the same resin composition and same molecular properties as the initial latex (i) used in blending or different composition and properties than that of the initial latex (i); a process wherein the aggregation is accomplished by heating at a temperature of below about the glass transition temperature of the polymer contained in the latex; a process wherein the coalescence is accomplished by heating at a temperature of about above the glass transition temperature of the polymer contained in the latex; a process wherein the aggregation temperature is from about 40° C. to about 62° C., or is from about 45° C. to about 58° C.; a process wherein the coalescence temperature is from about 75° C. to about 95° C., or from about 85° C. to about 90° C.; a process wherein there is added to the aggregate mixture prior to coalescence a base component; a process wherein the base is an alkali metal hydroxide; a process wherein the hydroxide is sodium hydroxide; a process wherein the pH of the mixture resulting after aggregation is increased from about 2 to about 2.6 to about 7 to about 8, during the coalescence, and wherein the base functions primarily as a stabilizer for the aggregates during the coalescence; a process wherein the amount of base selected is from about 8 to about 25 weight percent, or is about 10 to about 20 weight percent; a process wherein the amount of metal hydroxide selected is from about 11 to about 14 weight percent; a process wherein the acid is nitric, sulfuric, hydrochloric, acetic, citric, and the like; a process wherein the amount of acid selected is from about 4 to about 30 weight percent or from about 5 to about 15 weight percent; a process wherein the pH of the mixture resulting after the initial coalescence is reduced to from about 7.5 to about 5.5 and then to 4.5 to increase the rate of fusion or coalescence; a process wherein the latex contains a polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein the colorant is a pigment; a process wherein the colorant is carbon black, cyan, yellow, magenta, red, green, blue, violet, or mixtures thereof; a process wherein the toner isolated is from about 2 to about 10 microns in volume average diameter, and the particle size distribution thereof is from about 1.15 to about 1.30, a process wherein the latex is prepared by a batch and or a semicontinuous polymerization resulting in submicron resin particles suspended in an aqueous phase containing ionic surfactant; a process where the wax is completely retained in the toner and the silica is retained in excess of about 75 percent; processes for the preparation of toner particles which toner enables excellent print quality, and document appearance, and wide processing latitude, and wherein there is selected a latex preferably comprised of submicron resin particles, which are in the size range of about 0.05 to about 0.5 micron, or in the size range of about 0.07 to about 0.35 micron, suspended in an aqueous water phase and an ionic surfactant selected in an amount of about 0.5 to about 5 percent, or about 0.7 to about 2 percent by weight of solids, to which is added a colorant dispersion comprising submicron, for example less than, or equal to about 0.5 micron, colorant particles, anionic surfactant which is selected in the range amount of about 0.5 to about 10 percent and more specifically, about 0.6 to about 5 percent by weight of solids, which when blended together result in a mixture with a pH in the range of about 2 to about 2.6 to which a coated colloidal aluminized silica solution containing an acid like nitric acid is added slowly over, for example, a period of about 2 to about 5 minutes, followed by adding a solution of polyaluminum chloride containing nitric acid over a period of about 1 to about 3 minutes, further aggregating by stirring and heating from about 5 to about 10 degrees below the resin Tg, resulting in toner aggregates of a size of about 3 to about 15 microns or about 4 to about 8 microns with a narrow GSD in the range of, for example, about 1.14 to about 1.28 or in the range of about 1.17 to about 1.25, and which GSD enables the clean transfer of toner particles thereby providing enhanced resolution of the resulting developed fused images; followed by adjusting the pH of the mixture from about 2 to about 2.6 to a pH of about 6 to about 9 or about 7 to about 8.5, and preferably to a pH of about 8 with the addition of a dilute base solution of a 4 weight percent of sodium hydroxide, further stirring and increasing the mixture temperature above the resin Tg in the range of about 70° C. to about 95° C., or in the range of about 85° C. to about 93° C. for a period of about 0.5 to about 1.5 hours, followed by changing the pH from about 8 to about 3.8 by the addition of an acid, such as dilute nitric acid, and heating the mixture for an additional about 0.5 to about 4 hours or from about 0.6 to about 3 hours, to fuse or coalesce the aggregates, and then washing and drying the toner; a toner process wherein the solids content of the colloidal aluminized silica is in the range of about 0.05 to about 5 weight percent and wherein the alumina silica ratio is in the range of 1:99 to about 10:90 percent and wherein the coating of the alumina on the colloidal aluminized silica is in the range of about 0.001 to about 0.01 micron in thickness; a toner process wherein a wax dispersion is added to the latex (i) and colorant mixture; a process wherein washing the toner particles containing the toner slurry at a pH of 11 is followed by filtration and reslurrying of the filter cake comprised of toner particles in deionized water, followed by another deionized water wash and a single wash with only water at a pH of 4 where the pH of the slurry is adjusted with an acid; and processes for the preparation of toner compositions which comprise blending an aqueous colorant dispersion containing a pigment, such as carbon black, phthalocyanine, quinacridone or RHODAMINE B™ type, red, green, orange, brown, violet, yellow, fluorescent colorants and the like, with a latex emulsion derived from the emulsion polymerization of monomers selected, for example, from the group consisting of styrene, butadiene, acrylates, methacrylates, acrylonitrile, acrylic acid, methacrylic acid, itaconic or Beta Carboxy Ethyl Acrylate (BCEA) and the like, and which latex contains an anionic surfactant, such as sodium dodecylbenzene sulfonate, and which process is accomplished in the presence of a coated aluminized silica and polyaluminum chloride, heating the resulting flocculent mixture at a temperature below the latex (i) resin Tg for an effective length of time of, for example, about 0.5 hour to about 3 hours to form toner sized aggregates; and optionally adding a known amount of a second or delayed latex wherein this latex can be the same in composition as the initial latex (i) or dissimilar, followed by adjusting the pH of the mixture to from about 2 to about 8 with a dilute base solution of sodium hydroxide, and subsequently heating the aggregate suspension at a temperature above 95° C. for a period of about 0.5 to about 1 hour, adjusting the pH of the mixture from about 8 to about 4.5 with a dilute acid to provide toner particles, isolating the toner product by, for example, filtration, washing and drying in an oven, fluid bed dryer, freeze dryer, or spray dryer; a process for the preparation of toner comprising mixing a colorant, a latex, and a silica and polyaluminum chloride, which silica is coated with alumina; a process for the preparation of a toner composition wherein polyaluminum chloride can optionally be added during the aggregation step instead of the blending step; a process for the preparation of toner comprising mixing a colorant, a latex, and colloidal aluminized silica coagulant and polyaluminum chloride, and which coagulant primarily assists in permitting aggregation and coalescence of said colorant, and said latex resin; a process for the preparation of toner comprising the mixing of a colorant dispersion, a latex emulsion, a wax dispersion and a colloidal aluminized silica and polyaluminum chloride, and wherein said mixture is aggregated by heating below the latex resin glass transition temperature, and thereafter fusing said resulting aggregates by heating above the latex resin glass transition temperature, wherein said aggregate mixture is at a pH of from about 5 to about 8, and wherein said latex is comprised of resin, nonionic surfactant, ionic surfactant, and water; a process wherein the aggregation (iv) is accomplished by heating at a temperature below about glass transition temperature of the polymer contained in the latex; a process wherein the coalescence (vii) is accomplished by heating at a temperature of about above the glass transition temperature of the polymer contained in the latex; a process wherein the aggregation temperature is from about 40° C. to about 60° C.; a process wherein the coalescence temperature is from about 75° C. to about 97° C.; a process wherein the base is an alkali metal hydroxide; a process wherein the hydroxide is sodium hydroxide; a process wherein said coagulants are added during or prior to aggregation of the latex resin and colorant, and which coagulant enables or initiates the aggregation and optionally one of the coagulants can be added such as PAC during the aggregation step; a process wherein the aggregate pH is in the range of about 4 to about 6.8, and more specifically, in the range of about 4.5 to about 6; and a process wherein (v) is accomplished.

The particle size of the toner provided by the processes of the present invention in embodiments can be controlled, for example, by the temperature at which the aggregation of latex, colorant, such as pigment, and optional additives is conducted. In general, the lower the aggregation temperature, the smaller the aggregate size, and thus the final toner size. For a latex polymer with a glass transition temperature (Tg) of about 55° C. and a reaction mixture with a solids content of about 14 percent by weight, an aggregate size of about 7 microns in volume average diameter is obtained at an aggregation temperature of about 53° C.; the same latex will provide an aggregate size of about 5 microns at a temperature of about 48° C. under similar conditions. For a latex polymer with a glass transition temperature (Tg) of about 51° C. and a reaction mixture with a solids content of about 14 percent by weight, an aggregate size of about 7 microns in volume average diameter is obtained at an aggregation temperature of about 50° C.; the same latex will provide an aggregate size of about 5 microns at a temperature of about 45° C. under similar conditions.

Illustrative examples of specific latex resin, polymer or polymers selected for the process of the present invention include known polymers such as poly(styrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-butylacrylate), poly(styrene-butadiene), poly (styrene-isoprene), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the like. The latex polymer, or resin is generally present in the toner composition of the present invention in various suitable amounts, such as from about 75 weight percent to about 98, or from about 80 to about 95 weight percent of the toner or of the solids, and the latex resin size suitable for the processes of the present invention can be, for example, preferably from about 0.05 micron to about 0.5 micron in volume average diameter as measured by the Brookhaven nanosize particle analyzer. Other sizes and effective amounts of latex polymer may be selected in embodiments of the present invention. The total of all toner components, such as resin and colorant, is about 100 percent, or about 100 parts.

The polymer selected for the process of the present invention can be prepared by emulsion polymerization methods, and the monomers utilized in such processes include, for example, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol, in amounts of from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes for obtaining polymer particles of from, for example, about 0.01 micron to about 7 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes. Also, reactant initiators, chain transfer agents, and the like as disclosed in U.S. Ser. No. 922,437, the disclosure of which is totally incorporated herein by reference, can be selected for the processes of the present invention. Examples of water soluble initiators include, ammonium sodium, and potassium persulfates in suitable amounts, from about 0.1 to about 8 percent by weight of monomer, and more specifically, in the range of from about 0.2 to about 5 percent by weight of monomer. Examples of chain transfer agents include dodecanethiol, dodecylmercaptan, octanethiol, carbon tetrabromide, carbon tetrachloride, and the like in various suitable amounts, and are selected in the range amount of from about 0.1 to about 10 percent by weight of monomer, and more specifically, in the range of from about 0.2 to about 5 percent by weight of monomer.

Examples of waxes include those as illustrated herein, such as those of the aforementioned copending applications, and more specifically, polypropylenes and polyethylenes commercially available from Allied Chemical and Petrolite Corporation, wax emulsions available from Michaelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes selected usually possess a molecular weight $M_w$ of from about 1,000 to about 1,500, while the commercially available polypropylenes utilized for the toner compositions of the present invention are believed to have a molecular weight of from about 4,000 to about 5,000. Examples of functionalized waxes include amines, amides, imides, esters, quaternary amines, carboxylic acids or acrylic polymer emulsion, for example JONCRYL 74, 89, 130, 537, and 538, all available from S C Johnson Wax, chlorinated polypropylenes and polyethylenes commercially available from Allied Chemical and Petrolite Corporation and S C Johnson wax.

Various known colorants, such as pigments, selected for the processes of the present invention and present in the toner in an effective amount of, for example, from about 1 to about 25 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours and Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Yellow 180 and Permanent Yellow FGL, wherein the colorant is present, for example, in the amount of about 3 to about 15 weight percent of the toner. Organic dye examples include known suitable dyes, reference the Color Index, and a number of U.S. patents. Organic soluble dye examples, preferably of a high purity for the purpose of color gamut are Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, and more specifically, from about 5 to 20 weight percent of the toner. Colorants include pigment, dye, mixtures of pigment and dyes, mixtures of pigments, mixtures of dyes, and the like.

Examples of initiators for the preparation of both the initial latex of (i) and the added delayed latex wherein the delayed latex refers, for example to, the latex portion which is added to the already preformed aggregates in the size range of about 4 to about 6.5 $\mu$m, include water soluble initiators, such as ammonium and potassium persulfates in suitable amounts, such as from about 0.1 to about 8 percent, and more specifically, in the range of from about 0.2 to about 5 percent (weight percent). Examples of chain transfer agents include dodecanethiol, octanethiol, carbon tetrabromide and the like in various suitable amounts, such as in the range amount of from about 0.1 to about 10 percent, and more specifically, in the range of from about 0.2 to about 5 percent by weight of monomer.

Surfactants for the preparation of latexes and colorant dispersions can be ionic or nonionic surfactants in effective amounts of, for example, from about 0.01 to about 15, or from about 0.01 to about 5 weight percent of the reaction mixture. Anionic surfactants include sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. Examples of nonionic surfactants for the colorant dispersion selected in various suitable amounts, such as about 0.1 to about 5 weight percent, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, The silica cationic coagulant selected is in embodiments a silica with an alumina coating, that is for example, a colloidal dispersion of discrete spherical silica particles of pure, about 95 to about 100 percent pure, amorphous silicon dioxide with a coating of $Al_2O_3$ and wherein, for example, the surface thereof is modified to attain cationic properties, for example silica is usually of a negative charge, and hence to change the polarity is treated with a salt, such as an aluminum salt, and there is formed a coating of alumina on the silica particles thereby providing a function charge and hence a functionalized silica, and which coating on the silica provides a functionalized colloidal silica or a colloidal aluminized silica. The thickness of the alumina coating on the silica core is, for example, in the range of about 0.001 to 0.01 micron, and can in embodiments be up to about 1.5 microns. These cationic silica coagulants are commercially available and can be obtained as BINDZIL™, available from Akzo Nobel, LUDOX CL™, and others available from Aldrich, and LEVASIL® from Bayer Inc. Other coagulants used in conjunction with colloidal aluminum coated silica can be selected from a group of polyaluminum chloride (PAC), and polyaluminum sulfo silicate (PASS). The coagulant is most preferably in an aqueous media in an amount of, for example, from about 0.02 to about 0.3 percent by weight of toner and may contain minor amounts of other components, for example nitric acid.

The toner may also include known charge additives in effective suitable amounts of, for example, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa. The coated silicas of U.S. Pat. Nos. 6,190,815 and 6,004,714, the disclosures of which are totally incorporated herein by reference, can also be selected in amounts, for example, of from about 0.1 to about 2 percent, which additives can be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA), having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners of the present invention, reference for example a number of the patents mentioned herein, and U.S. Pat. Nos. 4,265,990; 4,858,884; 4,584,253 and 4,563,408, the disclosures of which are totally incorporated herein by reference.

The following Examples and Comparative Examples are provided. In these Examples, the P725 wax is a wax aqueous dispersion comprised of 30 weight percent of polyethylene wax in about 70 weight percent water, about 0.7 weight percent of an anionic surfactant of sodium dodecyl benzene sulfonate, and wherein the percent solids is 10 percent.

Latex Preparation—Semicontinuous

A latex emulsion (i) comprised of polymer particles generated from the emulsion polymerization of styrene, butyl acrylate and beta carboxy ethyl acrylate (Beta CEA) was prepared as follows. A surfactant solution of 434 grams of DOWFAX 2A1™ (anionic emulsifier) and 387 kilograms of deionized water was prepared by mixing for 10 minutes in a stainless steel holding tank. The holding tank was then purged with nitrogen for 5 minutes before transferring the mixture into a reactor. The reactor was then continuously purged with nitrogen while being stirred at 100 RPM. The reactor was then heated to 80° C.

Separately, 6.11 kilograms of ammonium persulfate initiator were dissolved in 30.2 kilograms of deionized water. Also, separately a monomer emulsion A was prepared in the following manner. 315.7 Kilograms of styrene, 91.66 kilograms of butyl acrylate, 12.21 kilograms of β-CEA, 7.13 kilograms of 1-dodecanethiol, 1.42 kilograms of decanediol diacrylate (ADOD), 8.24 kilograms of DOWFAX™ (anionic surfactant), and 193 kilograms of deionized water were mixed to form an emulsion. Five percent of the above emulsion was then slowly fed into the reactor containing the aqueous surfactant phase at 80° C. to form the seeds wherein the "seeds" refer, for example, to the initial emulsion latex added to the reactor, prior to the addition of the initiator solution, while being purged with nitrogen. The above initiator solution was then slowly charged into the reactor, forming about 5 to about 12 nanometers of latex "seed" particles. After 10 minutes, the remainder of the emulsion was continuously fed in using metering pumps.

Once all of the above monomer emulsion was charged into the main reactor, the temperature was maintained at 80° C. for an additional 2 hours to complete the reaction. The reactor contents were then cooled down to about 25° C. The resulting isolated product was comprised of 40 weight percent of submicron, 0.5 micron, resin particles of styrene/butylacrylate/βCEA suspended in an aqueous phase containing the above surfactant. The molecular properties resulting for the resin latex throughout were $M_w$ of 39,000, $M_n$ of 10.8, as measured by a Gel Permeation Chromatograph, and a midpoint Tg of 55.8° C., as measured by a Differential Scanning Calorimeter, where the midpoint Tg is defined as the halfway point between the onset and the offset Tg of the polymer.

TONER FABRICATION

EXAMPLE I

Cyan Toner (1 Percent Colloidal Aluminized Silica, 0.1 pph PAC, High Gloss)

248 Grams of the above prepared latex emulsion (i) and 52 grams of an aqueous wax dispersion of polyethylene P725 wax with a molecular weight ($M_w$) of about 750 and having a solids loading of 31 percent, and 36 grams of an aqueous cyan pigment dispersion PB 15.3, having a solids loading of 26.5 percent were simultaneously added to 557 grams of water with high shear stirring by means of a polytron. To this mixture were added 21.48 grams of an aggregant solution composed of 1.75 grams of PAC, 15.75 grams of 0.02 M $HNO_3$, and 3.98 grams of the water solubilized silica BINDZIL™ CAT 80, 0.04 micron in size diameter, and comprising a dispersion of discrete spherical silica particles of pure amorphous silicon dioxide with a coating thereover, about 100 percent coated, about 0.001 to about 0.01 micron in thickness of $Al_2O_3$ and a charge, and wherein the BINDZIL™ CAT 80 had a solids loading of 44 weight percent. The addition of the coagulant was accomplished over a period of 3 minutes, while being what was blended at a speed of 5,000 rpm for a period of 5 minutes. The resulting mixture was transferred to a 2 liter reaction vessel and heated at a temperature of 45° C. for 35 minutes resulting in aggregates of a size diameter (volume average) of 4.9 microns and a GSD of 1.19 as measured on a Coulter Counter. To the resulting aggregates 120 grams of the above prepared latex A were added followed by allowing the mixture to further aggregate for an additional 25 minutes resulting in particles with a size of 5.5 microns and a GSD of 1.20. The pH of the resulting mixture was then adjusted from about 2 to about 7.8 with an aqueous base solution of 4 percent sodium hydroxide and allowed to stir for an additional 15 minutes. Subsequently, the resulting mixture was heated to 95° C. and retained there for a period of 1 hour. The measured particle size was 5.5 microns with a GSD of 1.21. The particle size had not changed, however, the pH of the mixture was decreased to 6.4. The pH was then further reduced to 3.8 using a 2.5 percent nitric acid solution. The resultant mixture was allowed to coalesce for an additional 4 hours at a temperature of 95° C. The morphology of the toner particles was observed to be spherical under the optical microscope, and the measured (Coulter Counter) toner particle size was 5.6 with a GSD of 1.21. The reactor contents were then cooled down to room temperature, about 25° C. The resulting toner slurry pH was then further adjusted to 10 with a base solution of 5 percent of potassium hydroxide and stirred for 1 hour at room temperature, followed by filtration and reslurrying of the wet cake resulting in 1 liter of water, and then stirred for 1 hour. The above process was repeated followed by 1 wash at a pH of 4 (nitric acid). The final toner product, after drying in a freeze dryer, was comprised of 85 percent of the above resin, 5 percent of the above pigment, 9 weight percent of the above wax and 1 percent of the above colloidal aluminized silica, and the toner particle size was 5.6 microns in volume average diameter with a particle size distribution GSD of 1.21, both as measured on a Coulter Counter. The toner morphology was shown to be spherical in shape as determined by scanning electron microscopy. Silica analysis of the toner by ICP indicated a silica content of 0.45 percent indicating >99 percent incorporation of the toner. No wax rejection was observed in the wash waters. The dry toner was fused on a free-belt nip fuser of a seamless belt, 1.5 inches in diameter, constrained between a heated roll assembly and a fixed structure with a narrow high pressure strip. The belt moved in synchronization with the heated fuser roll because of the friction between the belt and the roll in the high pressure zone. This fuser provided fast warm up (instant on) as the assembly has minimal thermal mass requiring minimal energy to reach operating temperature. The fusing action took place over a wide zone in view of a low pressure pad that mounts under the belt forcing it in contact with the heated roll over a moderately long nip width of approximately 1 centimeter. The gloss attained was 44 GGU at a toner mass per area (TMA) of 1.05, and at a temperature of 180° C., as measured using a Gardner Gloss Meter using a 75° angle. The Minimum Fixing Temperature (MFT) was 147° C., wherein the MFT measurement involves folding an image fused at a specific temperature, and rolling a standard weight across the fold. The folded image is then unfolded and analyzed under the microscope and assessed a numerical grade by the computer based on the amount of crease showing in the fold. This procedure is repeated at various temperatures until the minimum fusing temperature (showing very little crease) is obtained. Rheology was measured using a Stress Rheometer SR 5000 from Rheometric Scientific using a parallel plate configuration of 40 millimeters and a gap width of 0.65 millimeters. The rheology at 180° was as follows: G'=219 Pascals, G"=242 Pascals, and $\eta$=52 Pascal*seconds.

EXAMPLE II

Cyan Toner (0.5 Percent of Colloidal Aluminized Silica, 0.14 pph of PAC, 0.04 pph of SANIZOL, High Gloss)

248 Grams of the above prepared latex emulsion (i) and 52 grams of an aqueous wax dispersion of polyethylene P725 wax with a molecular weight ($M_w$) of about 750 and having a solids loading of 31 percent, and 36 grams of an aqueous cyan pigment dispersion PB 15.3 having a solids loading of 26.5 percent were simultaneously added to 557 grams of water with high shear stirring by means of a polytron. To this mixture were added 27.02 grams of an aggregant solution composed of 2.52 grams of PAC, 22 grams of 0.02 M HNO3, and 1.78 grams of the water solubilized silica BINDZIL™ CAT 80, 0.04 micron in size diameter, and comprising a dispersion of discrete spherical silica particles of pure amorphous silicon dioxide with a coating thereover, about 100 percent coated, 0.001 to 0.01 micron in thickness of $Al_2O_3$ and a positive charge, and wherein the BINDZIL™ CAT 80 had a solids loading of 44 weight percent, and 0.72 gram of SANIZOL. The addition of the coagulant was accomplished over a period of 3 minutes while being blended at a speed of 5,000 rpm for a period of 5 minutes. The resulting mixture was transferred to a 2 liter reaction vessel and heated at a temperature of 45° C. for 35 minutes resulting in aggregates of a size diameter (volume average) of 4.9 microns and a GSD of 1.19. To the resulting aggregates, 120 grams of the above prepared latex A were added followed by allowing the mixture to further aggregate for an additional 25 minutes resulting in a particle with a size of 5.5 microns and a GSD of 1.20. The pH of the resulting mixture was then adjusted from 2 to 7.8 with an aqueous base solution of 4 percent sodium hydroxide and allowed to stir for an additional 15 minutes. Subsequently, the resulting mixture was heated to 95° C. and retained there for a period of 1 hour. The measured particle size was 5.5 microns with a GSD of 1.21. The particle size had not changed, however, the pH of the mixture has fallen to 6.4. The pH was then further reduced to 3.8 using a 2.5 percent nitric acid solution. The resultant mixture was allowed to coalesce for an additional 4 hours at a temperature of 95° C. The morphology of the toner particles was observed to be spherical under the optical microscope, and the measured (Coulter Counter) toner particle size was 5.6 with a GSD of 1.21. The reactor contents were then cooled down to room temperature, about 25° C. The resulting toner slurry pH was then further adjusted to 10 with a base solution of 5 percent of potassium hydroxide and stirred for 1 hour at room temperature, followed by filtration and reslurrying of the wet cake resulting in 1 liter of water, and then stirred for 1 hour. The above process was repeated followed by 1 wash at a pH of 4 (nitric acid). The final toner product, after drying in a freeze dryer, was comprised of 85.5 percent of the above resin, 5 percent of the above pigment, 9 weight percent of the above wax and 0.5 percent of the above colloidal aluminized silica, and the toner particle size was 5.7 microns in volume average diameter with a particle size distribution GSD of 1.20, both as measured on a Coulter Counter. The toner morphology was shown to be spherical in shape as determined by scanning electron microscopy. Silica analysis of the toner by ICP indicated a silica content of 0.23 percent indicating >99 percent incorporation of the toner. No wax rejection was observed in the wash waters. The toner was fused in a similar manner as stated in Example I. The gloss of this toner was 42 GGU at a 1.05 toner mass per area (TMA) at a temperature of 180° C. The MFT of the toner was 149° C. The rheology at 180° C. was as follows: G'=202 Pascals, G"=348 Pascals, and $\eta$=62 Pascal*seconds measured as stated in Example I.

EXAMPLE III

Cyan Toner (1.0 Percent of Colloidal Aluminized Silica, 0.2 pph of PAC, Low Gloss)

248 Grams of the above prepared latex emulsion (i) and 52 grams of an aqueous wax dispersion of polyethylene P725 wax with a molecular weight ($M_w$) of about 750 and having a solids loading of 31 percent, and 36 grams of an aqueous cyan pigment dispersion PB 15.3 having a solids loading of 26.5 percent were simultaneously added to 557 grams of water with high shear stirring by means of a polytron. To this mixture were added 39.88 grams of an aggregant solution composed of 3.5 grams of PAC, 31.5 grams of 0.02M $HNO_3$, and 3.98 grams of the water solubilized silica BINDZIL™ CAT 80, 0.04 micron in size diameter, and comprising a dispersion of discrete spherical silica particles of pure amorphous silicon dioxide with a coating thereover, about 100 percent coated, 0.001 to 0.01 micron in thickness of $Al_2O_3$ and a positive charge, and wherein the BINDZIL™ CAT 80 had a solids loading of 44 weight percent. The addition of the coagulant was accomplished over a period of 3 minutes, while being blended at a speed of 5,000 rpm for a period of 5 minutes. The resulting mixture was transferred to a 2 liter reaction vessel and heated at a temperature of 45° C. for 35 minutes resulting in aggregates of a size diameter (volume average) of 4.9 microns and a GSD of 1.19. To the resulting aggregates 120 grams of the above prepared latex A were added followed by allowing the mixture to further aggregate for an additional 25 minutes resulting in a particle with a size of 5.3 microns and a GSD of 1.20. The pH of the resulting mixture was then adjusted from 2 to 7.8 with an aqueous base solution of 4 percent sodium hydroxide and allowed to stir for an additional 15 minutes. Subsequently, the resulting mixture was heated to 95° C. and retained there for a period of 1 hour. The measured particle size was 5.3 microns with a GSD of 1.21. The particle size had not changed, however, the pH of the mixture had fallen to 6.4. The pH was then further reduced to 3.8 using a 2.5 percent nitric acid solution. The resultant mixture was allowed to coalesce for an additional 4 hours at a temperature of 95° C. The morphology of the toner particles was observed to be spherical under the optical microscope, and the measured (Coulter Counter) toner particle size was 5.4 with a GSD of 1.20. The reactor contents were then cooled down to room temperature, about 25° C. The resulting toner slurry pH was then further adjusted to 10 with a base solution of 5 percent of potassium hydroxide and stirred for 1 hour at room temperature, followed by filtration and reslurrying of the wet cake resulting in 1 liter of water, and then stirred for 1 hour. The above process was repeated followed by 1 wash at a pH of 4 (nitric acid). The final toner product, after drying in a freeze dryer, was comprised of 85 percent of the above resin, 5 percent of the above pigment, 9 weight percent of the above wax and 1 percent of the above colloidal aluminized silica, and the toner particle size was 5.5 microns in volume average diameter with a particle size distribution GSD of 1.21, both as measured on a Coulter Counter. The toner morphology was shown to be spherical in shape as determined by scanning electron microscopy. Silica analysis of the toner by ICP indicated a silica content of 0.46 percent indicating >99 percent incorporation of the toner. No wax rejection was observed in the wash waters. The toner was fused in a similar manner as that in Example I. The gloss of this toner was 30 GGU at a 1.05 toner mass per area (TMA) at a temperature of 180° C. The MFT of the toner was 150° C. The rheology at 180° C. was as follows: G'=1544 Pascals, G"=766 Pascals, and $\eta$=274 Pascal*seconds, measured as indicated in Example I.

EXAMPLE IV

Cyan Toner (2 Percent of Colloidal Aluminized Silica, 0.2 pph of PAC, Low Gloss)

248 Grams of the above prepared latex emulsion (i) and 52 grams of an aqueous wax dispersion of polyethylene P725 wax with a molecular weight ($M_w$) of about 750 and having a solids loading of 31 percent, and 36 grams of an aqueous cyan pigment dispersion PB 15.3 having a solids loading of 26.5 percent were simultaneously added to 557 grams of water with high shear stirring by means of a polytron. To this mixture were added 47 grams of an aggregant solution composed of 3.5 grams of PAC, 31.5 grams of 0.02 M $HNO_3$, and 12 grams of the water solubilized silica LUDOX™ CL, 0.012 micron in size diameter, and comprising a dispersion of discrete spherical silica particles of pure amorphous silicon dioxide with a coating thereover, about 100 percent coated, 0.001 to 0.01 micron in thickness of $Al_2O_3$ and a positive charge, and wherein the LUDOX™ CL had a solids loading of 29 weight percent. The addition of the coagulant was accomplished over a period of 3 minutes, while being blended at a speed of 5,000 rpm for a period of 5 minutes. The resulting mixture was transferred to a 2 liter reaction vessel and heated at a temperature of 45° C. for 35 minutes resulting in aggregates of a size diameter (volume average) of 4.9 microns and a GSD of 1.19. To the resulting aggregates 120 grams of the above prepared latex A were added followed by allowing the mixture to further aggregate for an additional 25 minutes resulting in a particle with a size of 5.3 microns and a GSD of 1.20. The pH of the resulting mixture was then adjusted from 2 to 7.8 with an aqueous base solution of 4 percent sodium hydroxide and allowed to stir for an additional 15 minutes. Subsequently, the resulting mixture was heated to 95° C. and retained there for a period of 1 hour. The measured particle size was 5.3 microns with a GSD of 1.21. The particle size had not changed, however, the pH of the mixture has fallen to 6.4. The pH was then further reduced to 3.8 using a 2.5 percent nitric acid solution. The resultant mixture was allowed to coalesce for an additional 4 hours at a temperature of 95° C. The morphology of the toner particles was observed to be spherical under the optical microscope, and the measured (Coulter Counter) toner particle size was 5.4 with a GSD of 1.20. The reactor contents were then cooled down to room temperature, about 25° C. The resulting toner slurry pH was then further adjusted to 10 with a base solution of 5 percent of potassium hydroxide and stirred for 1 hour at room temperature, followed by filtration and reslurrying of the wet cake resulting in 1 liter of water, and then stirred for 1 hour. The above process was repeated followed by 1 wash at a pH of 4 (nitric acid). The final toner product, after drying in a freeze dryer, was comprised of 84 percent of the above resin, 5 percent of the above pigment, 9 weight percent of the above wax and 2 percent of the above colloidal aluminized silica, and the toner particle size was 5.5 microns in volume average diameter with a particle size distribution GSD of 1.21, both as measured on a Coulter Counter. The toner morphology was shown to be spherical in shape as determined by scanning electron microscopy. Silica analysis of the toner by ICP indicated a silica content of 0.93 percent indicating >99 percent incorporation of the toner. No wax rejection was observed in the wash waters. The toner was fused in a similar manner as that stated in Example I. The gloss of this toner was 27 GGU at a 1.05 toner mass per area (TMA) at a temperature of 180° C. The MFT of the toner was 154° C. The rheology at 180° C. was as follows: G'=2,179 Pascals, G"=651 Pascals, and $\eta$=362 Pascal*seconds measured as stated in Example I.

Comparative Example

Cyan Toner (0 Percent of Colloidal Aluminized Silica, 0.25 pph of PAC, Low Gloss)

239.5 Grams of the above prepared latex emulsion (i) and 52 grams of an aqueous wax dispersion of polyethylene P725 wax with a molecular weight ($M_w$) of about 750 and having a solids loading of 31 percent, and 36 grams of an aqueous cyan pigment dispersion PB 15.3, having a solids loading of 26.5 percent were simultaneously added to 630 grams of water with high shear stirring by means of a polytron. To this mixture were added 36 grams of an aggregant solution composed of 4.5 grams of PAC, and 32.4 grams of 0.02 M $HNO_3$. The addition of the coagulant was accomplished over a period of 3 minutes, while being blended at a speed of 5,000 rpm for a period of 5 minutes. The resulting mixture was transferred to a 2 liter reaction vessel and heated at a temperature of 45° C. for 35 minutes resulting in aggregates of a size diameter (volume average) of 4.8 microns and a GSD of 1.22. To the resulting aggregates 136.8 grams of the above prepared latex A were added followed by allowing the mixture to further aggregate for an additional 25 minutes resulting in a particle with a size of 5.6 microns and a GSD of 1.20. The pH of the resulting mixture was then adjusted from 2 to 7.8 with an aqueous base solution of 4 percent sodium hydroxide and allowed to stir for an additional 15 minutes. Subsequently, the resulting mixture was heated to 95° C. and retained there for a period of 1 hour. The measured particle size was 5.5 microns with a GSD of 1.21. The particle size had not changed, however, the pH of the mixture had fallen to 6.4. The pH was then further reduced to 3.8 using a 2.5 percent nitric acid solution. The resultant mixture was allowed to coalesce for an additional 4 hours at a temperature of 95° C. The morphology of the toner particles was observed to be spherical under the optical microscope, and the measured (Coulter Counter) toner particle size was 5.5 with a GSD of 1.21. The reactor contents were then cooled down to room temperature, about 25° C. The resulting toner slurry pH was then further adjusted to 10 with a base solution of 5 percent of potassium hydroxide and stirred for 1 hour at room temperature, followed by filtration and reslurrying of the wet cake resulting in 1 liter of water, and then stirred for 1 hour. The above process was repeated followed by 1 wash at a pH of 4 (nitric acid). The final toner product, after drying in a freeze dryer, was comprised of 86 percent of the above resin, 5 percent of the above pigment, and 9 weight percent of the above wax, and the toner particle size was 5.5 microns in volume average diameter with a particle size distribution GSD of 1.21, both as measured on a Coulter Counter. The toner morphology was shown to be spherical in shape as determined by scanning electron microscopy. No wax rejection was observed in the wash waters. The toner was fused in a similar manner as that stated in Example I. The gloss of this toner was 35 GGU at a 1.05 toner mass per area (TMA) at a temperature of 180° C. The MFT of the toner was 162° C. The rheology at 180° C. was as follows: G'=312 Pascals, G"=370 Pascals, and $\eta$=77 Pascal*seconds measured as stated in Example I.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A process for the preparation of toner comprising mixing a colorant dispersion, a latex emulsion, a wax dispersion and coagulants comprising a colloidal alumina coated silica, and a polymetal halide.

2. A process in accordance with claim 1 wherein said colorant is a colorant dispersion comprised of (i) a colorant, water, and an ionic surfactant, or a nonionic surfactant, and wherein said latex is an emulsion comprised of an ionic surfactant, water and resin;

(ii) wherein said colorant dispersion is blended with said latex emulsion, and thereafter adding a wax dispersion comprised of submicron wax particles of from about 0.1 to about 0.5 micron in diameter by volume, which wax is dispersed in an ionic surfactant of the same charge polarity of said ionic latex surfactant;

(iii) adding to the resulting blend said alumina coated silica and said metal halide of polyaluminum chloride to thereby initiate flocculation or aggregation of said resin latex, said colorant, and said wax when present;

(iv) heating the resulting mixture below about, or about equal to the glass transition temperature (Tg) of the latex resin to form toner sized aggregates;

(v) adding to the formed toner aggregates a second latex comprised of resin suspended in an aqueous phase containing an ionic surfactant and water;

(vi) adding to the resulting mixture a base to thereby change the pH which is from about 2 to about 2.9 to arrive at a pH of from about 5 to about 8 for the resulting toner aggregate mixture;

(vii) heating the resulting aggregate suspension of (vi) above about, or about equal to the Tg of the latex resin of (i);

(viii) optionally retaining the mixture temperature at from about 70° C. to about 95° C. optionally for a period of about 10 to about 60 minutes, followed by a pH reduction with an acid to arrive at a pH of about 3.5 to about 5 to assist in permitting the fusion or coalescence of the toner aggregates;

(ix) washing the resulting toner slurry; and (x) isolating the toner.

3. A process in accordance with claim 2 wherein the minimum fix temperature of the toner is from of about 140° C. to about 155° C.

4. A process in accordance with claim 2 wherein said base is selected from the group consisting of sodium hydroxide, potassium hydroxide, and ammonium hydroxide.

5. A process in accordance with claim 2 wherein there is added to the formed toner aggregates a second latex comprised of submicron resin particles suspended in an aqueous phase containing an anionic surfactant, and wherein said second latex is selected in an amount of from about 10 to about 40 percent by weight of the initial latex to form a shell thereover on said formed aggregates, and which shell is of a thickness of about 0.2 to about 0.8 micron.

6. A process in accordance with claim 5 wherein the added latex contains the same resin as the initial latex of (i), or wherein said added latex contains a dissimilar resin than that of the initial latex.

7. A process in accordance with claim 2 wherein the pH of the mixture resulting in (vi) is increased from about 2 to about 2.6 to about 5 to about 8, and wherein said base functions primarily as a stabilizer for the aggregates during coalescence (vii), and no or minimal toner particle size or GSD increases result.

8. A process in accordance with claim 2 wherein the temperature at which toner sized aggregates are formed controls the size of the aggregates, and wherein the final toner size is from about 2 to about 15 microns in volume average diameter.

9. A process in accordance with claim 2 wherein the aggregation (iv) temperature is from about 45° C. to about 60° C., and wherein the coalescence or fusion temperature of (vii) is from about 85° C. to about 95° C.

10. A process in accordance with claim 2 wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly (styrene-butyl acrylate-acrylononitrile-acrylic acid).

11. A process in accordance with claim 1 wherein said colloidal silica is a colloidal dispersion of discrete spherical particles with a purity of from about 80 to 100 percent pure amorphous silicon dioxide, and wherein the surface thereof has an alumina coating of $Al_2O_3$.

12. A process in accordance with claim 1 wherein the amount of colloidal alumina coated silica is from about 0.05 to about 2 percent by weight of toner and the amount of polymetal halide is about 0.14 to about 0.02 percent by weight of toner thereby optionally providing a toner exhibiting a glossy finish.

13. A process in accordance with claim 12 wherein the glossy toner exhibits a viscosity of about 35 to about 250 pascals per second at about 125° C. to about 175° C.

14. A process in accordance with claim 12 wherein the toner exhibits a viscosity of about 260 to about 500 pascals per second at from about 150° C. to about 190° C.

15. A process in accordance with claim 1 wherein the amount of colloidal alumina coated silica selected is from about 1 to about 3 percent by weight of toner and the amount of polymetal halide, which halide is polyaluminum chloride, is from about 0.3 to about 0.15 percent by weight of toner, and wherein there is provided a toner exhibiting a matte finish with a gloss of about 8 to about 35 GGU measured at a temperature of 180° C.

16. A process in accordance with claim 1 and wherein the toner possesses a gloss of about 35 to about 80 GGU.

17. A process in accordance with claim 1 wherein the alumina ($Al_2O_3$) coating has a thickness of about 0.001 to about 0.01 micron, and wherein (viii), (ix) and (x) are accomplished.

18. A process in accordance with claim 1 wherein the latex resin particles are from about 0.15 to about 0.3 micron in volume average diameter.

19. A process in accordance with claim 1 wherein the colorant is a pigment, a dye or mixtures thereof, and which colorant optionally is submicron in size of about 0.08 to about 0.34 micron in average volume diameter.

20. A process in accordance with claim 1 wherein said colloidal for said alumina coated silica is of about 0.005 to about 0.1 micron in diameter.

21. A process in accordance with claim 1 wherein the colorant is a pigment, and wherein said pigment is in the form of dispersion, and which dispersion contains an ionic surfactant and optionally a nonionic surfactant, and wherein said alumina coated silica and said polymetal halide, which is polyaluminum chloride, are of a colloidal size and function as a coagulant and assists in the enablement of aggregation of said latex and said colorant.

22. A process in accordance with claim 1 wherein the latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid).

23. A process in accordance with claim 1 wherein the colorant is carbon black, cyan, yellow, magenta, orange, green, violet or mixtures thereof; the toner isolated is from about 2 to about 15 microns in volume average diameter, and the particle size distribution thereof is from about 1.15 to about 1.30; and wherein there is added to the surface of the formed toner metal salts, metal salts of fatty acids, silicas, metal oxides, or mixtures thereof, each in an amount of from about 0.1 to about 10 weight percent of the obtained toner.

24. A process on accordance with claim 1 wherein the colloidal alumina coated silica is water solubilized in a slightly acidic pH environment, and wherein the pH is about 3 to about 6.5.

25. A process in accordance with claim 1 wherein said coagulants primarily assist in permitting aggregation and coalescence of said colorant, said latex resin and said wax, and wherein said halide is a polyaluminum chloride.

26. A process in accordance with claim 1 wherein the polymetal salt selected can be either a polyaluminum chloride or a polyaluminum sulfosilicate.

27. A process in accordance with claim 1 wherein subsequent to said mixing there is accomplished a heating at a first temperature and a subsequent heating at a second temperature, and wherein the first temperature is below the glass transition temperature of a resin contained in said latex emulsion, and wherein said second temperature is above the glass transition temperature of a resin contained in the latex emulsion.

28. A process in accordance with claim 1 wherein said colloidal aluminum coated silica is selected in an amount of from about 0.05 to about 2 weight percent.

29. A process in accordance with claim 1 wherein said polymetal halide is selected in an amount of from about 0.14 to about 0.02 percent by weight.

30. A process for the preparation of toner comprising the mixing of a colorant dispersion, a latex emulsion, a wax dispersion, a colloidal alumina coated silica, and a polymetal halide, and wherein said mixture is aggregated by heating below the latex resin glass transition temperature, and thereafter fusing said resulting aggregates by heating above the latex resin glass transition temperature wherein said aggregate mixture is at a pH of from about 5 to about 8, and wherein said latex is comprised of resin, nonionic surfactant, ionic surfactant, and water.

31. A process for the preparation of toner comprising mixing a colorant, a latex, a colloidal alumina coated silica, and a polymetal halide wherein said colloidal is of a size diameter of from about 20 to about 150 nanometers, and optionally wherein said polymetal salt is a polyaluminum chloride or a polyaluminum sulfosilicate.

* * * * *